US008015924B1

(12) United States Patent
Maines et al.

(10) Patent No.: US 8,015,924 B1
(45) Date of Patent: Sep. 13, 2011

(54) LINEAR CELLULAR BOMB CASE

(75) Inventors: Warren R. Maines, Pensacola, FL (US); Michael P. Kramer, Wellsville, UT (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 145 days.

(21) Appl. No.: 12/474,325

(22) Filed: May 29, 2009

(51) Int. Cl.
*F42B 12/22* (2006.01)

(52) U.S. Cl. ..... 102/492; 102/493

(58) Field of Classification Search ..... 102/473, 102/491, 492, 493, 494, 495, 496, 497, 517
See application file for complete search history.

(56) References Cited

U.S. PATENT DOCUMENTS

| | | | | |
|---|---|---|---|---|
| 3,491,694 | A * | 1/1970 | Fountain | 102/493 |
| 3,566,794 | A * | 3/1971 | Pearson et al. | 102/493 |
| 3,799,054 | A * | 3/1974 | LaRocca | 102/491 |
| 4,089,267 | A * | 5/1978 | Mescall et al. | 102/491 |
| 4,108,073 | A * | 8/1978 | Davis | 102/518 |
| 4,722,280 | A * | 2/1988 | Sanai | 102/289 |
| 4,815,386 | A * | 3/1989 | Dillard et al. | 102/364 |
| 5,131,329 | A * | 7/1992 | Lips et al. | 102/364 |
| 5,337,673 | A * | 8/1994 | Koontz et al. | 102/491 |
| 6,857,372 | B2 * | 2/2005 | Renaud-Bezot et al. | 102/493 |
| 7,117,797 | B2 * | 10/2006 | Biserod et al. | 102/288 |
| 7,383,775 | B1 * | 6/2008 | Mock et al. | 102/363 |
| 7,886,667 | B1 * | 2/2011 | Baker et al. | 102/495 |
| 2005/0087088 | A1 * | 4/2005 | Lacy et al. | 102/495 |

* cited by examiner

*Primary Examiner* — James Bergin
(74) *Attorney, Agent, or Firm* — AFMCLO/JAZ; Bart S. Hersko

(57) ABSTRACT

A warhead consisting of a relatively thin metal shell casing and interior open linear cells which run throughout its length manufactured by electrical discharge machining and slip fitting.

14 Claims, 1 Drawing Sheet

LINEAR CELLULAR BOMB CASE

RIGHTS OF THE GOVERNMENT

The invention described herein may be manufactured and used by or for the Government of the United States for all governmental purposes without the payment of any royalty.

BACKGROUND OF THE INVENTION

The invention reengineers the metal case mass of a typical General Purpose (GP) bomb or Unitary Penetrating (UP) warhead into open linear cells, which are contained in the case volume. The cells can be of any geometry, such as hexagons, circles, trapezoids, etc, and may be twisted, segmented or rifled down the interior length of the bomb.

The practice of filling open linear cells with explosives began with the discovery of Linear Cellular Alloys, which were developed at Georgia Technical Institute in the 1990's. These materials did not have precise engineering tolerances and weren't used for warheads at that time. The Thin Unitary Multi-purpose Penetrator (THUMP) was developed by Air Force Research Laboratory using the principles of open linear cells but was not effective due to poor manufacturing processing, and general lack of quality control.

In an effort to overcome the deficiencies of these previous methods, the applicant machined open linear cells via by Electrical Discharge Milling (EDM) into a billet of steel, filled the warhead with explosive and tested it in the field.

The range of qualities required or desired for this bomb includes the following:

Matching the impedance of the case with the impedance of the fuze well of the bomb.

A. Maintain 5% or less axial strain in the overall case structure.

B. Physical partitioning of chemical species in the bomb fills.

C. Easy alternative fuzing designs.

D. Stress bridging structure to enhance explosive survivability during penetration.

E. Controlled Fracture and blast.

F. Relatively low cost.

G. Straightforward manufacturing.

Other objects, aspects and advantages of the invention will be apparent to those skilled in the art from the following description of the invention.

SUMMARY OF THE INVENTION

In accordance with the present invention there is provided an open linear cell format suitable for use as linear cellular bomb case, which consists of a series of concentric cylinders with interconnecting reticulated webs that are filleted to remove stress concentrations.

Also provided in accordance with the present invention, is a Unitary Penetrating (UP) warhead or bomb having the open linear cell design integrated into the case structure. The bomb comprises a casing wall and an explosive enclosed by the casing wall. The casing wall contains open linear cells, wherein the open linear cells are contained in the case volume between the outer wall of the casing and the explosive.

DETAILED DESCRIPTION OF THE INVENTION

Open Linear Cell

As used herein, the term "Open Linear Cell" refers to a parallel aligned thin-walled structure without enclosed ends created by wall elongation, of which the most representative form is the honeycomb.

Designs of open linear cellular structure are nearly limitless. However, Young's modulus and compressive strength decrease sharply with an increasing amount of missing walls. Shear deflection is minimized by triangular shapes. Variations in the walls also negatively impact these properties due to anisotropic conditions. Therefore, it is beneficial to have uniform wall thicknesses and to have any sharp edges filleted to remove stress concentrations. In Finite Element Analysis tests that Applicants conducted prior to manufacturing, it was found that stresses could promulgate and the structure would dynamically fail if fillets were not incorporated into the design. Applicants also determined that filled cells were stronger. For example, at relatively large strains, the cell walls did not collapse as easily. The combination of triangular shaped walls with Filler E (inert version of an explosive) reinforced the structural stability.

Geometric considerations also proved to have quite an effect on the payload stability. Applicants found that having a reticulating structure built on a fractal algorithm provided enhanced strain stability. For example, if the center cylinder was considered to be 1 cell, then the second concentric ring would contain 8 cells, and that those cells would be followed by another 4 cells each. Each of those cells outside of the center was based on triangular truss design, which is known to be very stable. This kind of design offered the greatest overall buckling stability, and minimized the payload shear.

For a more detailed discussion of open linear cells, see, e.g., Lorna J. Gibson, M. F. (1997), *Cellular Solids, Second Edition*. Cambridge: Cambridge University Press, incorporated herein by reference.

Bomb Incorporating Open Linear Cells in the Case Structure

Figure 1:
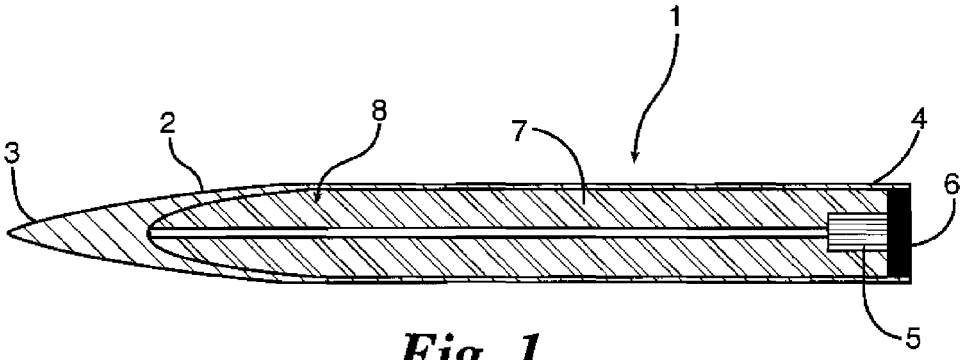
FIG. 1 is a longitudinal cross-section of a generic unitary penetrator warhead or bomb, which incorporates the open linear cells.

Referring to FIG. 1, a generic unitary penetrator warhead or bomb is generally indicated at 1. The bomb 1 comprises a case 2, which is thinned to roughly ½ of its normal thickness, having a nose end portion 3 and a tail end portion 4. The tail end portion 4 comprises an aft fuzewell 5 having an associated access plate 6. The bomb 1 has open linear cells 7 integrated into case 2, which are created from the mass that was thinned out from the case 2. Not shown are mounting lugs. The remainder of the cavity of case 2, indicated by the reference numeral 8 is filled with high explosive.

Figure 2:
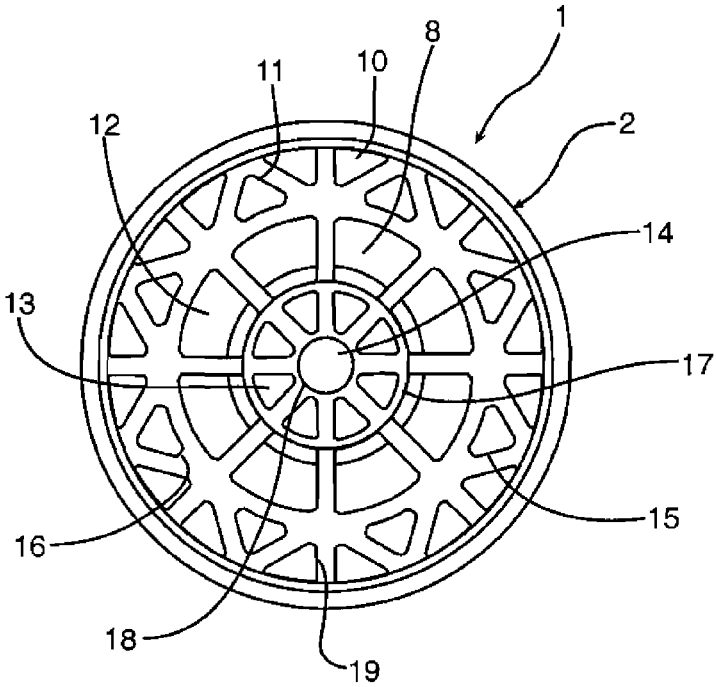
FIG. 2 is an axial cross-section of a generic unitary penetrator warhead or bomb, which incorporates open linear cells in the case structure.

Referring to FIG. 2, a preferred operating mode geometry of open linear cells 10, 11, 12, 13 and 14 are indicated inside 2 [which is the bomb case]. The cells 10, 11, 12, 13 and 14 are created by joining reticulating webbing 15 that is roughly 10% of the cell volume, to concentric cylinders, 16, 17, and 18 of the same percentage of cell volume thereby creating a void that is 90% of the total cell volume. The thickness of the cell walls are roughly $1/10^{th}$ of the cross sectional area of the cell. The open linear cell structure is bisected by additional connecting ligaments 19 that are 22.5 degrees in symmetry. The cells extend throughout the entire length of the bomb, and mate with the fuzewell. Applicants found that the above geometry provided a static strength an order of magnitude above other hexagonal honeycomb forms that were attempted. It is important to fillet any sharp corners to remove stress concentrations. A fillet radius of 0.1 inch or greater is recommended. The open linear cells are preferably introduced into the bomb in multiple sections with two separate techniques, Electric Discharge Machining (EDM) and Friction Welding. An EDM creates 12-16 inch sections of the bomb, excluding the nose and fuzewell sections. These major sections are then friction welded end to end until the entire assembly is created. The welds are then ground down to the surface of the warhead skin. For a more detailed discussion of Electric Discharge Machining and Friction Welding techniques, see e.g., A. W. Beck, T. F. (1969), *Close Tolerance Sizing of Honeycomb By Electrical Discharge Machining*. Sample Journal Vol 5:6 and David A. Siefert, K. E. (10 Oct. 2007). *Friction Welding of Missle Systems Hardware*. Final Report, Battelle Columbus Division, Columus; both of which references are incorporated herein by reference.

The second sequence is creating the nose and fuzewell sections. The nose and the fuzewell of the bomb are created separately. The interior of the nose portion of the case is machined with mating notches such that the open linear cells, which are a revolved boss cut, can be fit into the nose. The open linear cell structure portion is then inserted into the nose section of the bomb by heating the nose section, and chilling the cellular structure. The cellular form is inserted or, slip fit, into the nose section and allowed to come to room temperature. This creates a tight fitting cellular nose form, which is friction welded to the bomb body as described in the above paragraph. The fuzewell is created in a similar fashion, first by creating a tail section complete with tail plate threads, and slip fitting the fuzewell open linear cellular form into the tail section, and friction welding this section to the bomb body.

Alignment is critical. The speed of the welding process is material dependent. Spin welding often times creates a weld joint that is stronger than the actual material itself, and can be used to design fragment size. The combination of fast joining times of the order of a few seconds, and the direct heat input at the weld interface, gives rise to relatively small heat affected zones. Friction welding techniques are generally melt-free, which offers the advantage of avoiding grain growth in engineered materials such as high-strength heat-treated steels. Another advantage is that the motion tends to "clean" the surface between the materials being welded, which means they can be joined without as much prior preparation. During the welding process, depending on the method being used, small pieces of the "plastic" metal will be forced out of the working mass in rippled sheets of metal known as "flash". It is believed that the flash carries away debris and dirt.

At some later time, a plastic or asphaltic liner is cast into the invention along with high explosive.

Advantages Obtained from Open Linear Cells in the Case Structure

It has been found that the reticulating structures of the open linear cells create controlled fragment distribution. Experiments have shown that fragments are typically lighter and faster, with fewer junk fragments than a typical bomb cylinder. This is caused by the detonation, and subsequent detonation products expansion wave being guided by the reticulation structure of the linear open cells. It has also been found that the reticulation structures themselves remain mostly intact, due to the fact that the travel distance of the shock wave in the reticulations is much longer than in the concentric circle portions. Therefore, one portion of the case is in tension, while the other is in compression. This set of wave interactions creates shear in the invention and creates shear controlled fragmentation.

The second major advantage to the linear cell bomb design is the forward fragmentation projection. As the detonation wavelets travel down the length of each cell in the bomb, they interact with the nose portion as Taylor shock wavelets. Therefore, the detonation wavelets in the cells interact with the nose just before the waves in the cell walls. As previously stated, this interaction creates a situation where portions of the nose are under compression by the shock wavelets, while other portions are under tension created by edge losses from the walls of each cell. The shear set up by this wave interaction focuses forward fragmentation in the nose of the bomb caused by the subsequent expansion wave caused by the detonation products.

The third major advantage is caused by the Janssen Effect [Janssen, H. (1895). *H. A. Janssen*. Zeitschr. d. Vereines deutscher Ingenieure 39, 1045. Springer-Verlag]. The Janssen effect creates a stress bridge which lowers the stresses that the explosive fill must carry during the penetration event. The result is that the Janssen Effect keeps the explosive from cracking, while undergoing penetration.

The fourth major advantage is impedance matching the interior of the bomb with the fuze. Typical fuze kits are screwed into the fuse well and interact only with the explosive fill. The impedance between the explosive and the fuze material can be over seven times in difference. Therefore, the weak shock generated by the penetration event runs up the case wall and interacts with the fuze before the weak shock arrives from moving through the explosive fill. This invention reduces the strain in the fuze well by providing direct weak shock communication through the explosive. The result is that the fuze does not have a tendency to eject upon impact.

The fifth major advantage is chemical separation. This invention provides a mechanism for physical separation of chemical species. The open linear cells in of themselves are physical barriers, which can be used as a means to load different kinds of explosives and chemicals into a bomb.

What is claimed is:

1. A bomb comprising a metal casing wall and an explosive enclosed by said casing wall, wherein said bomb further comprises interior open linear cells integrated into the inside of the casing wall, wherein said open linear cells are made from the same material as the metal casing wall and therefore have the same material impedance as the casing wall, wherein said open linear cells help control the fragment distribution upon detonation of said bomb.

2. The bomb of claim 1 having a fuzing placed along at least one section of the explosive.

3. The bomb of claim 1 wherein said explosive is contained in said linear cells, thereby enabling the explosive to carry higher mechanical loads.

4. The bomb of claim 1 wherein the cells of the casing are loaded with chemical species.

5. The bomb of claim 4 wherein said chemical species are physically portioned by said linear cells.

6. The bomb of claim 5 wherein said casing further provides a mechanism for forward fragment focusing.

7. The bomb of claim 1 wherein said linear cells enable controlled fragmentation and blast of the munitions without reducing the ability of the casing to survive penetration events.

8. The bomb of claim 1 that is manufactured via Electrical Discharge Machining.

9. The bomb of claim 8, in which said open linear cells are slip fit.

10. The bomb of claim 1 wherein said bomb is made in sections and the bomb sections are welded via friction welding.

11. The bomb of claim 10, in which said open linear cells are slip fit.

12. The bomb of claim 1 in which the casing wall is thinned out and replaced with open linear cells.

13. The bomb of claim 12, in which said open linear cells are slip fit.

14. The bomb of claim 1, in which the linear cells are of any shape or geometry, which run the length or a portion of the length of a bomb.

* * * * *